United States Patent [19]

Graves, Jr. et al.

[11] Patent Number: 4,880,018

[45] Date of Patent: Nov. 14, 1989

[54] EXTRUDED TOBACCO MATERIALS

[75] Inventors: William H. Graves, Jr., Pfafftown; Gary W. Wallace, Winston-Salem; Bruce P. Bradford, Lewisville; Carolyn R. Carpenter; Kenneth W. Smith, both of Winston-Salem; Howard C. Toft, Clemmons, all of N.C.

[73] Assignee: R. J. Reynolds Tobacco Company, Winston-Salem, N.C.

[21] Appl. No.: 80,715

[22] Filed: Jul. 31, 1987

Related U.S. Application Data

[63] Continuation-in-part of Ser. No. 826,462, Feb. 5, 1986, Pat. No. 4,724,850.

[51] Int. Cl.[4] ..... A24B 3/14

[52] U.S. Cl. ..... 131/375; 131/355

[58] Field of Search ..... 131/375, 370, 355

[56] References Cited

U.S. PATENT DOCUMENTS

| | | |
|---|---|---|
| 2,433,877 | 1/1948 | Wells et al. . |
| 2,708,175 | 5/1955 | Samfield et al. . |
| 2,769,734 | 11/1956 | Bandel . |
| 2,845,933 | 8/1958 | Samfield et al. . |
| 2,887,414 | 5/1959 | Rosenberg et al. . |
| 3,076,729 | 2/1963 | Garbo . |
| 3,098,492 | 7/1963 | Wurzburg et al. . |
| 3,203,432 | 8/1965 | Green et al. . |
| 3,364,935 | 1/1968 | Moshy et al. . |
| 3,386,449 | 6/1968 | Hind . |
| 3,404,690 | 10/1968 | Moshy et al. . |
| 3,480,018 | 11/1969 | Fairchild . |
| 3,542,035 | 11/1970 | Dierichs . |
| 3,821,959 | 7/1974 | Schmidt . |
| 3,932,081 | 1/1976 | Buchmann et al. . |
| 3,968,804 | 7/1976 | Kelly et al. . |
| 4,058,129 | 11/1977 | Beringer et al. . |
| 4,109,663 | 8/1978 | Maeda et al. . |
| 4,164,948 | 8/1979 | Beringer et al. . |
| 4,306,578 | 12/1981 | Schmidt et al. . |
| 4,333,484 | 6/1982 | Keritsis . |
| 4,341,228 | 7/1982 | Keritsis et al. . |
| 4,347,855 | 9/1982 | Lanzillotti et al. . |
| 4,391,285 | 7/1983 | Burnett et al. . |
| 4,510,950 | 4/1985 | Keritsis et al. . |
| 4,598,721 | 7/1986 | Stiller et al. . |
| 4,632,131 | 12/1986 | Burnett et al. . |
| 4,730,629 | 3/1988 | Graves, Jr. et al. . |

*Primary Examiner*—V. Millin

[57] ABSTRACT

Extruded smokable material is provided by extruding a moist mixture of divided tobacco and a binding agent which includes locust bean gum and xanthan gum. The mixture is subjected to temperatures about 80° C. during extrusion such that this binding agent components are solubilized and the binding agent is activated. The adhesive character of the binding agent is believed to be provided by heat initiated inter polymer chain associations between the component binders. The tobacco material and binding agent mixture is extruded above the temperature at which the activated agent forms a gel. The extrudated is cooled and the binding agent forms a gel, resulting in a resilient smokable material.

55 Claims, 3 Drawing Sheets

EXTRUDED TOBACCO MATERIALS

REFERENCE TO RELATED APPLICATION

This application is a continuation-in-part of copending U.S. patent application Ser. No. 826,462, filed Feb. 5, 1986, now U.S. Pat. No. 4,724,850.

BACKGROUND OF THE INVENTION

The present invention relates to the manufacture of smokable materials, and in particular to the processing of tobacco products using extrusion technology.

Cured tobacco leaf conventionally undergoes several processing steps prior to the time that the resulting cut filler is provided. For example, tobacco leaves are threshed in order to separate the tobacco laminae from the stem. The tobacco laminae undergo further processing resulting in cut filler, while the stems are discarded or employed in the manufacture of reclaimed tobacco products which are traditionally of relatively low quality.

The handling, threshing and storing stages of conventional tobacco leaf processing steps result in the formation of considerable amounts of wasted tobacco material. In particular, typical processing conditions cause the formation of relatively large amounts of dust and fines. Such dust and fines are of such a small size as to be of essentially no use in the manufacture of cigarettes. However, it is possible to retrieve some of the dust and fines, and employ these materials with tobacco stems in the manufacture of reclaimed tobacco materials. Numerous references address methods for providing reclaimed or reconstituted tobaccos. See, for example, U.S. Pat. No. 3,480,018 to Fairchild.

U.S. Pat. No. 3,203,432 to Green et al proposes grinding tobacco to a small size, mixing the tobacco with water, and extruding the moist mixture into filamentary form. However, the reference proposes extruding the mixture so as to release the inherent gumminess of the tobacco. The reference does not propose the use of any binding agent additive in the disclosed process.

U.S. Pat. No. 4,598,721 to Stiller et al proposes producing crimped fiber pieces from tobacco waste using an extruder having a die head for producing filiform products and a rotating blade at the die head. Although the references proposes the use of a binder, the reference contains no teaching or suggestion of a particular binding agent.

U.S. Pat. No. 3,932,081 to Buchmann et al proposes extruding smokable fibers from a suspension of ground tobacco. The proposed suspension is an aqueous slurry of sodium carboxymethylcellulose and other additives.

U.S. Pat. No. 4,347,855 to Lanzillotti et al and U.S. Pat. No. 4,391,285 to Burnett et al propose extruding smoking articles having highly specific shapes and configurations as well as controlled porosities and densities. However, the proposed processes do not suggest the extrusion of smokable materials using binding agent additives. Rather, the references propose a release of the natural binding agents of tobacco during the extrusion process.

U.S. Pat. Nos. 4,510,950 and 4,625,737 to Keritsis et al propose providing foamed, extruded tobacco-containing smoking articles. In particular, a wet blend of tobacco dust and a cellulosic binder is extruded such that the resulting extrudate (which preferably has a cylindrical rod shape) is formed.

It would be highly desirable to provide an efficient and effective process for providing smokable materials using extrusion technology.

SUMMARY OF THE INVENTION

The present invention relates to an extruded smokable material. Preferably, the smokable material is provided by extruding a moist mixture of divided tobacco material and a binding agent. If desired, other filler materials can be processed with the tobacco material. The binding agent is a heat activated binding agent which includes a synergistic mixture of at least two binders. Preferably, the binding agent includes a synergistic mixture of (i) a galactomannan binder, and (ii) at least one other binder. The extrusion conditions generally are such that the moisture level, temperature and pressure cause the binding agent components to be solubilized thereby. The extrusion conditions also are such that the synergistic mixture of solubilized binders is subjected to activation conditions thereby. Preferably, the binders are such that the resulting binding agent is one which is activated by exposing the binding agent to temperatures significantly above ambient temperature. The tobacco/binding agent mixture which is extruded is cooled below the temperature at which the binding agent forms a gel. The resulting extrudate is collected and is employed in the manufacture of smoking articles such as cigarettes.

The invention allows for the reclamation and/or processing of tobacco material in an efficient and effective manner using a process which requires neither large amounts of moisture nor the necessity of employing large amounts of binders. Of particular interest is the fact that the binding agent is heat activated, preferably in a reversible manner, such that the smokable material can be processed and reprocessed at temperatures above ambient temperature. However, the preferred binding agent gels, and thereby provides good binding characteristics at temperatures below about 45° C. Thus the preferred binding agents can be employed in manufacturing a smokable material which is relatively resilient at ambient temperatures. In addition, the binding characteristics of the binding agent at ambient temperatures are such that the binding agent is quite moisture resistant at levels of moisture frequently encountered during the processing of tobacco strip and filler materials for cigarette manufacture. Thus, the resulting extruded tobacco material exhibits excellent physical properties and can be easily handled at ambient temperatures.

The resulting extruded smokable material can be employed using techniques known in the art. For example, the extruded smokable material can be further processed, treated with additives, blended with other materials, cut or otherwise processed to achieve the desired size, or the like. Most preferably, the extruded smokable material is employed as cut filler or tobacco extender for the manufacture of cigarettes. Materials of this invention exhibit excellent smoking properties.

DETAILED DESCRIPTION OF THE PREFERRED EMBODIMENTS

Figure 1:
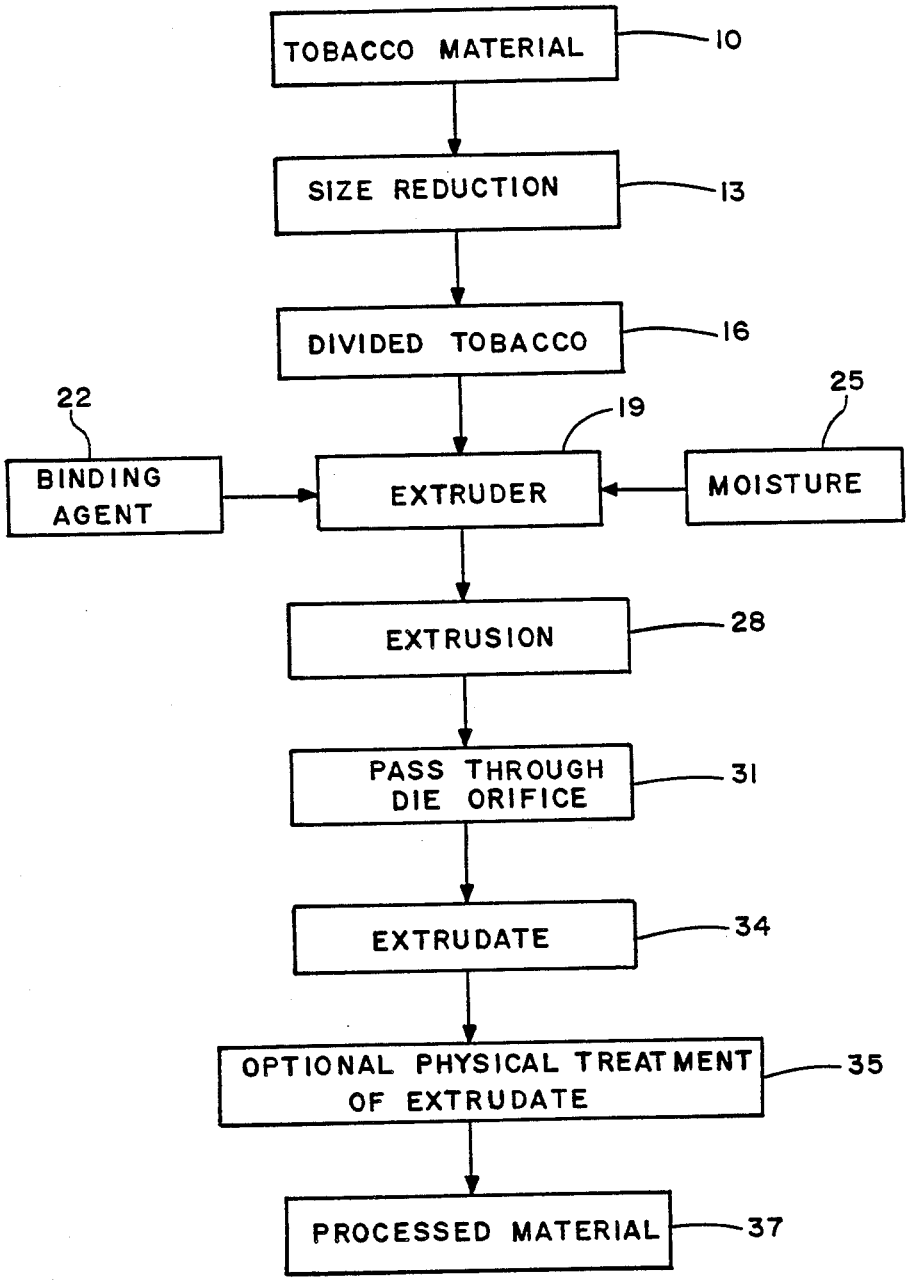
FIGS. 1 and 2 are schematic diagrams of preferred embodiments of the representative processing steps of this invention.

Referring to FIG. 1, tobacco material 10 is subjected to a size reduction step using a ball mill 13, or other suitable comminuting apparatus. The comminuted tobacco material 16 is transferred to the feed zone of an extruder 19. Binding agent 22 is metered into the feed zone of the extruder 19. The comminuted tobacco material 16 and binding agent 22 are dry blended within the extruder 19, and the desired level of moisture 25 is metered into the mixture. The resulting moist mixture is subjected to extrusion conditions 28 including an elevated temperature in order to provide a well mixed, semi-soft, semi-solid material while solubilizing components of the binding agent and activating the binding agent. The semi-soft, semi-solid material is passed through opening(s) in die 31, and the resulting extrudate 34 is collected. The manner in which the extrudate is collected can vary and depends upon the desired use of that material. If desired, the extrudate exiting the extruder die can be subjected to treatment using a roller system 35, or to other physical treatment. Such optional physical treatment is particularly desirable for mixtures having moisture contents below about 40 weight percent. The resulting material is cooled to ambient temperature to yield resilient processed tobacco material 37.

Figure 2:
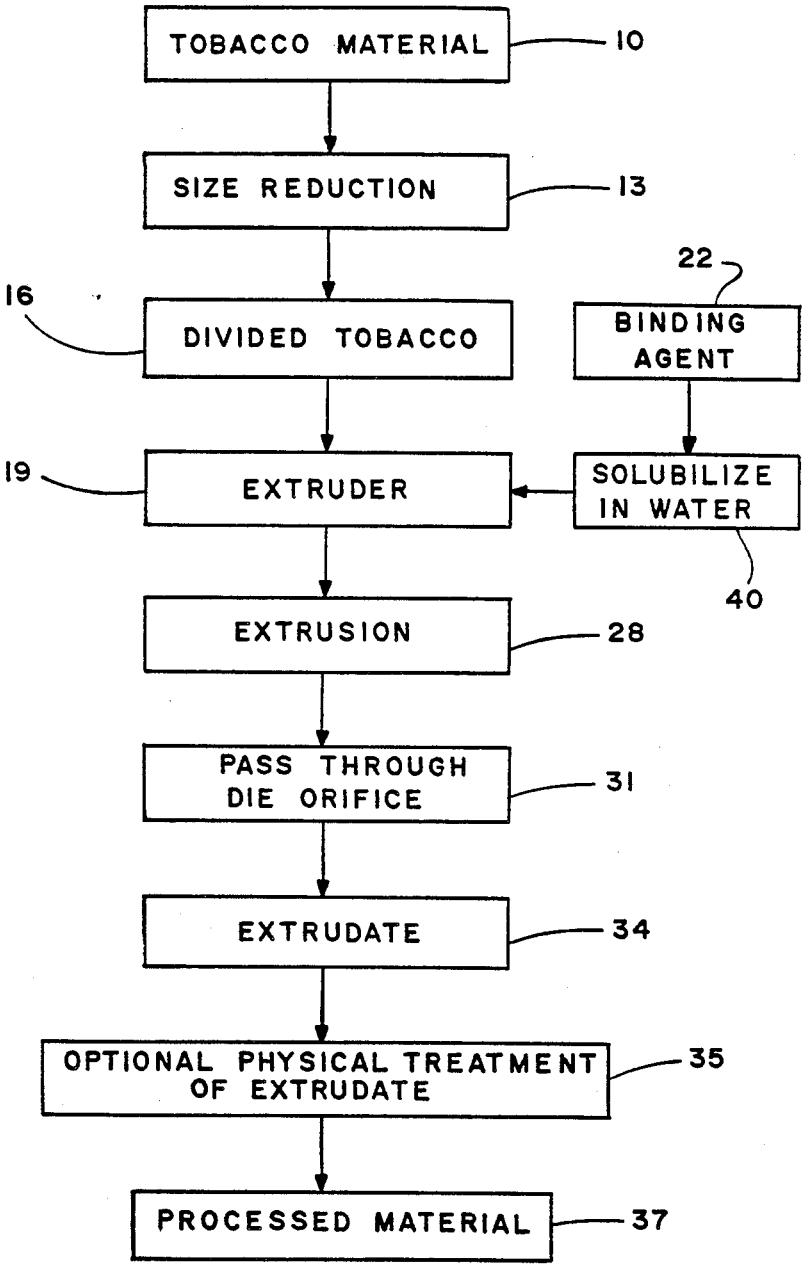

Referring to FIG. 2, tobacco material 10 is subjected to a size reduction step using a ball mill 13, or other suitable comminuting apparatus. The comminuted tobacco material 16 is then transferred to the feed zone of the extruder 19. Separately, binding agent 22 is solubilized in aqueous medium 40 at a temperature above ambient temperature. The aqueous medium containing the solubilized binding agent is metered into the extruder 19 such that the desired level of moisture and binding agent are contacted with the tobacco material. The resulting moist mixture is subjected to extrusion conditions 28 including an elevated temperature in order to activate the binding agent and to provide a well mixed, semi-soft, semi-solid material. The semi-soft, semi-solid material is passed through opening(s) in die 31, and the resulting extrudate 34 is collected. If desired, the extrudate exiting the extruder die can be subjected to treatment using a roller system 35, or to other physical treatment. Such optional physical treatment is particularly desirable for mixtures having moisture contents below about 40 weight percent. The resulting material is cooled to ambient temperature to yield resilient processed tobacco material 37.

The tobacco materials useful in this invention can vary. Typically, tobacco materials include tobacco fines, tobacco dust, tobacco laminae, tobacco cut filler, volume expanded tobacco, scrap tobacco which is recovered from various processing stages and cigarette manufacture stages, tobacco stems and stalks, scraps and/or sheets of reconstituted tobacco material, rolled tobacco stems, tobacco in essentially whole leaf form, and the like, as well as combinations thereof. The original sizes of the various pieces and particles of tobacco material are not particularly critical.

The term "essentially whole leaf form" is meant to include the entire leaf including the stem. Tobacco material in essentially whole leaf form includes cured tobacco provided from prize houses; and aged tobacco provided from bales, hogsheads and boxes. In particular, the total leaf including stem can be employed without throwing away any portion thereof. Generally, tobacco material in essentially whole leaf form includes tobacco which is not threshed or de-stemmed. However, it is desirable to clean or de-sand tobacco leaf using a screening technique or the like, prior to further processing steps.

Types of tobaccos useful herein most preferably include Burley, flue-cured, Maryland and Oriental tobaccos. Other types of tobaccos such as the rare or specialty tobaccos also can be employed. The various tobaccos can be employed separately or as blends thereof.

If desired, the tobacco material can be processed along with an amount of another filler material. For purposes of this invention, the term "filler material" relates to the tobacco material as well as to any other material capable of providing a portion of the volume of the extruded smokable material in addition to the tobacco material. Examples of suitable filler materials other than tobacco material include carbonized or pyrolyzed materials, tobacco substitute materials, organic filler materials such as grains, inorganic filler materials such as clays, calcium carbonate or aluminas, or other such materials, and blends thereof. The amount of other filler material which is employed relative to the tobacco material depends upon the desired smoking properties and physical characteristics of the ultimate smoking material.

If desired, flavorants, casing or topping dressing materials, or other flavor enhancing materials can be incorporated into the mixture which is ultimately extruded. The flavor additives can be added at various stages of the process. The selection and levels of flavor additives which are employed will be apparent to the skilled artisan.

The binding agent useful herein includes at least two binders, and is capable of being activated under the conditions of temperature, pressure and moisture which are experienced by the binding agent during extrusion conditions. Preferably, the binding agent includes a galactomannan and at least one other binder. Examples of preferred galactomannans are locust bean gum and tara gum, of which locust bean gum is especially preferred. Examples of the other binders are those which undergo a heat initiated interaction with the galactomannan. Examples of especially preferred other binders are the carrageenans such as kappa-carrageenan, and the xanthomonas hydrophilic colloid (also commonly known as xanthan gum); of which xanthan gum is most preferred. For example, a synergistic mixture of solubilized locust bean gum and xanthan gum can reversibly form a gel after cooling a heated aqueous mixture thereof to below the gel point of the binding agent (i.e., to below a temperature of about 55° C.). A binding agent composed of locust bean gum and xanthan gum is especially preferred, as gelling can occur as a result of a thermal mechanism without the presence of additives such as potassium ions. Additives such as potassium ions are most desirably present to promote gelation of a binding agent having kappa-carrageenan as a component. The level of potassium ions required to produce gelation of the mixture of galactomannan and kappa-carrageenan can be readily determined by experimentation.

The amount of binders employed relative to one another to form the binding agent can vary. For example, a suitable binding agent can include about 15 percent to about 75 percent locust bean gum, preferably about 25 percent to about 65 percent locust bean gum, more preferably about 40 percent to about 60 percent locust bean gum; and about 25 percent to about 85 percent xanthan gum, preferably about 35 percent to about 75 percent xanthan gum, more preferably about 40 percent to about 60 percent xanthan gum, based on the total weight of the binding agent.

The amount of binding agent which is employed relative to the tobacco and optional filler materials can vary. Typically, relatively low amounts of binding agent are employed. Binding agent levels necessary to provide the desired physical properties to the ultimately extruded material depend upon factors such as the available moisture and the extruder efficiency when the filler material/binding agent mixture is processed. Inefficient processing conditions may result in inefficient solubilization and activation of the binders and binding agent thereby requiring the use of relatively high levels of binding agent to obtain extrudate having the desired physical properties. It is preferable that the binding agent be employed at between about 0.2 and about 6 percent, more frequently less than about 5 percent, and more preferably between about 1 and about 4 percent, and most preferably between about 2 to about 3 percent, based on the total weight of binding agent and filler material dry weight.

The filler materials generally have a controlled particle size in order to optimize the efficiency with which the materials are extruded. Typically, the tobacco materials and optional filler materials are reduced in size so as to have individual particle sizes of less than about 30 mesh, preferably less than about 40 mesh, more preferably less than about 60 mesh, and most preferably less than about 100 mesh. The filler material is provided in a small size by grinding or otherwise reducing the size of the material using a grinder, a hammer mill, a ball mill or other suitable size reducing apparatus. The comminuted filler material can be transferred to the extruder without further processing. If desired, the size reduction steps can be performed within the barrel of the extruder using a high shear screw element or shear producing screw element.

The comminuted tobacco material, optional filler material and the binding agent are contacted with one another in a manner which can vary. For example, the binding agent can be employed in a substantially dry, non-activated form, and can be added bulk-wise to the comminuted filler material. Preferably, the binding agent is dispersed within or mixed with the filler material, and then the desired level of moisture is applied to the mixture. If desired, the mixing of dry binding agent and comminuted filler material can be performed in the barrel of the extruder. However, mixing of the materials can occur before the materials are fed into the extruder. As another example, the binding agent is mixed with moisture and subjected to conditions such that binding agent components are solubilized. Then the solubilized binding agent, any further moisture and filler material are fed into the extruder and subjected to mixing.

As used herein, the term "solubilize" in referring to the binder components of the binding agent is meant to include the ability of the binder or binding agent to be hydrated, partially hydrated, or uniformly distributed throughout the aqueous solvent.

Typically, locust bean gum is solubilized in an aqueous solvent at a temperature above about 80° C. As employed in this invention, the locust bean gum can be solubilized in the aqueous solvent and then have the other binder contacted therewith. Typically, such contact occurs within the extruder. Alternatively, the binding agent can be subjected to conditions such that the binding agent components are solubilized. Upon solubilization of the binding agent components, the binding agent can be employed in further steps of the invention such that the binding agent behaves as a gel upon cooling below the gel point of the binding agent.

As used herein, the term "activation" in referring to the binding agent is meant to include the introduction of the latent adhesive properties to the binding agent. The latent adhesive properties of the binding agent are the adhesive properties which arise upon heating the solubilized components of the binding agent above some activation temperature. Activation can be provided by heat in combination with moisture, pressure, shear energy, or other such physical parameters. For example, upon activation, the binding agent begins to behave generally as an adhesive which is capable of forming a gel upon cooling and thereby adhering filler material together. Generally, a mixture of moist tobacco and activated binding agent exhibits a semi-soft, formable, somewhat consistent, or somewhat dough-like character, and can be somewhat sticky or tacky in nature. It is believed that the components of the binding agent exhibit a synergistic binding character as a result of inter polymer chain associations which are believed to occur between the component binders. Such inter polymer chain associations are believed to be initiated by subjecting the component binders of the binding agent to the temperatures and conditions which provide activation of the binding agent.

Binding agents which are thermally activated are cooled to below their gel point, which generally is some temperature above ambient temperature. Preferred gels are not overly soft and are not overly brittle. Typical preferred gels have elastic, rubbery, somewhat resilient characteristics, and have good integrity and consistency at ambient temperatures and at the moisture levels at which the gels are obtained during the process steps of this invention.

The extruders useful herein include the single screw and twin screw extruders. Suitable extruders include the commercially available Brabender, Werner and Pfleiderer Continua 37 27:1 L/D, Wenger TX-52 34:1 L/D and Baker Perkins MPF-50/25:1 L/D extruders. Co-rotating twin screw extruders are especially preferred. Preferred extruders also include the so-called "cooker extruders" which provide for heating of the material during processing. Various screw configurations can be employed. For example, screws having combinations of feed screw elements, mixing elements, shearing elements, and the like, can be selected as desired for optimum results. Typical screw elements as well as screws having combinations of such elements are available from the extruder manufacturers. Operation of such extruders will be apparent to the skilled artisan.

The moisture content of the filler material/binding agent mixture during extrusion conditions can vary. The mixture has a moisture content such that the mixture has a semi-soft, semi-solid character suitable for extruding. Typically, a low moisture content mixture requires a greater amount of energy in order to ultimately provide extruded product; while a high moisture content mixture yields a product of poor tensile strength or requires undesirable energy intensive drying processes. Typically, the tobacco material, optional filler material and the binding agent are processed such that the moisture content thereof at some point during extrusion is at least about 15 weight percent, preferably at least about 17 weight percent; but most frequently is less than about 45 weight percent, preferably less than about 40 weight percent, more preferably less than about 30 weight percent. Typically, the moisture content of the filler material and binding agent during extrusion is between about 18 weight percent and about 25 weight percent.

The moistened filler material/binding agent mixture is subjected to extrusion conditions. Extrusion conditions can vary, but generally involve a mixing of materials at temperatures above ambient temperature within the barrel of the extruder followed by a forcing of the mixed materials through the opening(s) or orifice(s) in the die of the extruder. For example, in situations wherein the binding agent is a combination of locust bean gum and xanthan gum, an aqueous solvent containing locust bean gum can be subjected to solubilization conditions, and the mixture of tobacco material and binding agent can be extruded at temperatures above that at which the binding agent is activated. In such a situation, the mixture can be extruded under conditions such that the temperature is about 55° C. or higher, preferably about 60° C. or higher. Alternatively, in situations wherein the binding agent is mixed with the filler material, but the galactomannan component of the binding agent has not been solubilized, the resulting mixture is heated to temperatures above the temperature at which all the components of the binding agent solubilize. Such heating most preferably occurs during extrusion. For example, a binding agent which includes locust bean gum and xanthan gum can be mixed with the tobacco material and moisture and subjected to extrusion conditions at temperatures above about 80° C., preferably in the range from about 90° C. to about 110° C. In such a situation, the locust bean gum and xanthan gum are solubilized, and the extrusion temperatures are above that temperature at which the binding agent is activated.

The time period over which the moist mixture of filler material and binding agent is subjected to extrusion conditions can vary. Typically, extrusion conditions are performed at temperatures above the temperature at which the binding agent is activated and for a period of time sufficient to adequately mix the filler material and binding agent. Typically, longer extruder barrels provide longer residence times of materials therewithin. Adequate mixing and shearing of the moist mixture typically is provided within the barrel of the extruder over a period ranging from about 15 seconds to about 2 minutes, more frequently from about 30 seconds to about 1 minute. The mixed, semi-solid material then is forced through the opening(s) or orifice(s) of the extruder die.

The extrudate exits the die opening(s) or orifice(s) of the extruder at a temperature which is greater than the point at which the binding agent forms a gel. For example, in situations wherein the binding agent is a mixture of locust bean gum and xanthan gum, the extrudate should exhibit a temperature above about 55° C. immediately upon exiting the die orifice. However, it is preferred that the extrudate which exits the die exhibit a temperature of about 90° C. to 110° C. Under such conditions, extrudate normally having a moisture content of about 15 to about 35 weight percent is collected, depending upon the initial moisture content of the extruded mixture. Typically, the extrudate cools rather quickly causing the binding agent to gel thereby yielding a resilient smokable material. The cooled material is springy and flexible, and can be easily handled. Extrudate of low moisture content typically is more rigid in character than extrudate of higher moisture content.

The extrudate can be collected as is, and employed in the manufacture of smoking articles. For example, the extrudate can be collected in a bin or other suitable container, or deposited onto a moving belt or other conveyor means. If desired, the extrudate can be chopped into short strands or shreds. Oftentimes, the extrudate can be continuous strands which are immediately chopped into short strands or shreds using a rotating knife, or the like. The extrudate can be subjected to treatment using pressure rollers in order to provide compressive treatment to reduce the thickness thereof. It is preferable to subject the extrudate to physical treatment (eg., using pressure rollers, or the like) while the extrudate is warm (eg., immediately after leaving the die) and before the binding agent begins to cool and gel. For example, the die can have a configuration such that the extrudate is directly fed into the nip zone of a pair of rollers in roll contact. Typical roll treatment is provided using roller systems having very high separation forces.

After processing steps are complete, the extrudate can be dried to moisture levels between about 10 weight percent and about 15 weight percent for further use.

The extrudate which is provided according to the process of this invention can be provided in a variety of shapes. The shape of the extrudate generally is dependent upon the configuration of the extruder die, as the die is determinative in imparting the desired shape to the resulting smokable material. The extrudate can have the form of strand, flake, sheet, a tube, a cylinder, a cylinder having a series of passageways extending longitudinally therethrough, a cylinder having a honeycomb-like cross sectional shape, or any other desired shape. As the shape and components of the extrudate can vary considerably, the extrudate can be employed in the manufacture of a variety of smoking articles.

The extrudate can be provided generally in the form of a sheet. The sheet-like material exhibits good flexibility and tensile strength. By the term "sheet" as used herein is meant that the material is in a form wherein the length and width thereof are substantially greater than the thickness thereof. Typically, the thickness of the sheet approximates that of tobacco leaf, cured or processed tobacco leaf, or wet reconstituted tobacco sheet product. For example, the thickness of the sheet preferably ranges from about 0.002 inch to about 0.02 inch, more preferably from about 0.002 inch to about 0.008 inch. The length and width of the sheet or strip of processed material can vary. The width of the sheet generally is determined by factors such as the extrusion die configuration, or the physical treatment of the extrudate. The sheet-like material exhibits good flexibility and tensile strength. Typically, the processed sheet having a thickness comparable to tobacco laminae exhibits a structural strength which approaches that of tobacco laminae. It is most desirable that the sheet exhibit good physical properties while being as thin as possible. The sheet can be cut as are tobacco leaf or wet formed reconstituted tobacco material (eg., in strands or shreds at about 32 cuts per inch) using various conventional cutting devices. The extrudate can be cased, top dressed and treated with numerous flavorants, mixed with other smokable materials, and employed as cut filler in the manufacture of cigarettes.

The extrudate can be provided generally in shredded form or the form of a strand. The extrudate in shredded or strand form exhibits good flexibility and tensile strength. Typically, the processed material in shredded or strand form, having physical dimensions comparable to tobacco cut filler, exhibits a structural strength which approaches or exceeds that of tobacco cut filler; and can be processed with conventional cut filler in a cigarette making operation without the loss of substantial structural integrity. The thickness of the shredded material or strand is comparable to that of the previously described sheet-like material. For most applications, the width of each shred or strand is comparable to that of cut filler. However, strands having a cross sectional shape which is circular, square, rectangular, oval, trapezoidal, or the like can be provided depending upon the die configuration. Strands can be engineered using the process of this invention in order to exhibit significant amounts of crimp or curl in order to improve the packing density thereof.

The following examples are provided in order to further illustrate various embodiments of the invention but should not be construed as limiting the scope thereof. Unless otherwise noted, all parts and percentages are by weight.

EXAMPLE 1

Extruded tobacco in sheet-like form is provided as follows.

One part tobacco stem, one part tobacco scrap and one part tobacco dust are comminuted using a ball mill to provide finely divided tobacco material of 60 mesh. The moisture content thereof is about 11 percent.

The comminuted tobacco material is fed into the the feed zone of a Baker Perkins MPF-50/15:1 L/D twin screw extruder at a rate of 1.86 pounds per minute. The feed zone is equipped with a feed screw element in order to provide a forward conveying of the dry feed. The screw speed is 300 rpm. Into the feed zone is metered in a blend of dry, granular binding agent and finely divided tobacco material. The binding agent-/tobacco material blend is 1 part binding agent and 4 parts of the finely divided tobacco material. The binding agent/tobacco material blend is metered into the extruder at the rate of 0.18 pounds per minute. The binding agent is a mixture of 1 part locust bean gum and 1 part xanthan gum. The binding agent is available from Kelco, Division of Merck & Co., Inc., San Diego, California.

Separately, a mixture of the binding agent and water is provided. The mixture includes 2.3 percent binding agent. The mixture is heated to 80° C. and is metered into the extruder barrel through a feed port at the rate of about 1 pound per minute.

The extruder has 5 independently controlled temperature zones. Each zone extends longitudinally along the screw a distance equal to 3 diameters of the screw. The first zone is positioned adjacent to the 25 HP drive motor of the extruder, and the second zone is positioned adjacent the first zone. The feed port for the tobacco material and binding agent is at a distance of about 1.5 diameters along the barrel. The mixture is metered into the extruder through a feed port positioned about 4 diameters along the extruder barrel from the drive motor. The moisture is metered into the tobacco material/-binding agent mixture in order to provide a 40 percent moisture content thereto. The temperature in the first zone is set at 160° C. and actual barrel temperature is 33° C. The temperature of the material within the zone is 58° C. The pressure within the zone is 450 psi.

The second temperature zone is set at 52° C. and the actual barrel temperature is 44° C. The temperature of the material within the zone is 46° C. The screw within the second zone includes, in series, a feed screw element extending 1.5 diameters, a paddle element extending about 0.25 diameters, and a short pitch feed screw extending about 1.25 diameters along the barrel. The pressure within the zone is 440 psi.

The third temperature zone is set at 66° C. and the actual barrel temperature is 45° C. The temperature of the material within the zone is 106° C. The screw within the third zone includes, in series, three 60° forward paddles and three 30° reverse paddles (which combine to the extend 1.5 diameters along the barrel), a single lead screw extending about 1.25 diameters along the barrel, and two 45° forward paddles extending about 0.25 diameter along the barrel. The pressure within the zone is 450 psi.

The fourth temperature zone is set at 82° C. and the actual barrel temperature is 89° C. The temperature of the material within the zone is 103° C. The screw within the fourth zone includes, in series, two 45° forward paddles and three 45° reverse paddles (which combine to extend 1.25 diameters along the barrel), a feed screw extending 1.5 diameters along the barrel, and a single lead screw extending 0.25 diameter along the barrel. A feed port is positioned along the barrel about 1.25 diameters into the fourth zone. Glycerin is metered into the fourth zone through the feed port at 0.04 pounds per minute, and is contacted with the heated, moist tobacco material/binding agent mixture.

The fifth temperature zone is set at 93° C. and the actual barrel temperature is 93° C. The screw within the fifth zone includes, in series, a single lead screw extending 1 diameter along the barrel, three 60° forward paddles and two 30° reverse paddles (which combine to extend about 1.25 diameters along the barrel), and a single lead screw extending about 1 diameter along the barrel.

Figure 3:
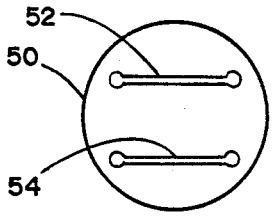
FIGS. 3 through 5 are end views of various dies showing die orifice configurations.

The extruder is fit with a circular die shown in FIG. 3. The die 50 has a diameter of about 2.5 inch and has two die openings 52 and 54 extending therethrough. Each opening has a beaded edge at each end thereof. Each opening has a length of 1.55 inch and a width of 0.03 inch. The configuration of the die openings is shown in FIG. 3. The thickness or land area of the die is 0.75 inch.

The barrel temperature at the die is about 95° C. Extrudate in sheet-like form continuously exits the die and is collected. The resulting material can be physically treated using a pressurized roller system in order to reduce the thickness thereof.

EXAMPLE 2

Extruded tobacco in strand form is provided as follows.

One part tobacco stem, one part tobacco scrap and one part tobacco dust are comminuted using a ball mill to provide finely divided tobacco material of 60 mesh. The moisture content thereof is about 11 percent.

The comminuted tobacco material is fed into the the feed zone of a Baker Perkins MPF-50/15:1 L/D twin screw extruder at a rate of 1.76 pounds per minute. The feed zone is equipped with a feed screw element in order to provide a forward conveying of the dry feed. The screw speed is 300 rpm. Into the feed zone is metered in a blend of dry, granular binding agent and finely divided tobacco material. The binding agent-/tobacco material blend is 1 part binding agent and 4 parts of the finely divided tobacco material. The binding agent/tobacco material blend is metered into the feed zone of the extruder at the rate of 0.3 pounds per minute. The binding agent is a mixture of 1 part locust bean gum and 1 part xanthan gum.

The extruder has 5 independently controlled temperature zones. Each zone extends longitudinally along the screw a distance equal to 3 diameters of the screw. The first zone is positioned adjacent to the 25 HP drive motor of the extruder. The feed port for the tobacco material and binding agent is at a distance of about 1.5 diameters along the barrel. Moisture in the form of water is metered into a feed port positioned at a distance of almost 3 diameters along the barrel. The moisture is metered into the tobacco material/binding agent mixture in order to provide a 30 percent moisture content thereto. The temperature in the first zone is set at 16° C. and actual barrel temperature is 36° C. The temperature of the material within the zone is 163° F. The pressure within the zone is 350 psi.

The second temperature zone is set at 52° C. and the actual barrel temperature is 54° C. The temperature of the material within the zone is 62° C. The screw within the second zone includes, in series, a feed screw element extending 1.5 diameters, a paddle element extending about 0.25 diameters, and a short pitch feed screw extending about 1.25 diameters along the barrel. The pressure within the zone is 350 psi.

The third temperature zone is set at 66° C. and the actual barrel temperature is 64° C. The temperature of the material within the zone is 78° C. The screw within the third zone includes, in series, three 60° forward paddles and three 30° reverse paddles (which combine the extend 1.5 diameters along the barrel), a single lead screw extending about 1.25 diameters along the barrel, and two 45° forward paddles extending about 0.25 diameter along the barrel. The pressure within the zone is 360 psi.

The fourth temperature zone is set at 66° C. and the actual barrel temperature is 72° C. The temperature of the material within the zone is 107° C. The screw within the fourth zone includes, in series, two 45° forward paddles and three 45° reverse paddles (which combine to extend 1.25 diameters along the barrel), a feed screw extending 1.5 diameters along the barrel, and a lead screw extending 0.25 diameter along the barrel. A feed port is positioned along the barrel about 1.25 diameters into the fourth zone. Glycerin is metered into the fourth zone through the feed port at 0.04 pounds per minute, and is contacted with the heated, moist tobacco material/binding agent mixture.

The fifth temperature zone is set at 71° C. and the actual barrel temperature is 71° C. The screw within the fifth zone includes, in series, a single lead screw extending 1 diameter along the barrel, three 60° forward paddles and two 30° reverse paddles (which combine to extend about 1.25 diameters along the barrel), and a single lead screw extending about 1 diameter along the barrel.

Figure 4:
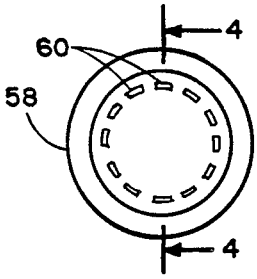
Figure 4A:
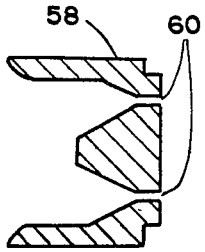
FIG. 4A is a cross sectional view of the die insert shown in FIG. 4 and taken along lines 4—4 in FIG. 4.

The extruder is fit with a circular die insert shown in FIGS. 4 and 4A. The die insert 58 has 12 identical rectangular openings 60 of 0.030 inch length by 0.015 inch width extending through the face thereof. The configuration of the die openings is shown in FIG. 4. The insert die has a diameter of 1.25 inch and a length of 0.9 inch.

The barrel temperature at the die is 106° C. Extrudate in continuous strand form exits the die and is collected. The strands exhibit a resilient characteristic very rapidly and can be handled within 30 seconds. The strands can be employed as cut filler in the manufacture of cigarettes.

If desired, a die face rotating cutter can be positioned immediately adjacent the die face and operated at 1200 rpm in order to provide shredded material which can be collected on a moving conveyor belt.

EXAMPLE 3

Sheet form tobacco extender is provided from tobacco material using the following procedure.

Tobacco material is extruded using materials and conditions generally as described in Example 1, except that the die 50 has two openings 52 and 54, each of 1.55 inch length and 0.010 inch width. The resulting extrudate has a thickness of about 0.010 inch, is diced into 2 to 3 inch lengths, and can be used as tobacco leaf lamina or strip in the manufacture of smoking articles.

EXAMPLE 4

Strand form tobacco extender is provided from tobacco material using the following procedure.

Figure 5:
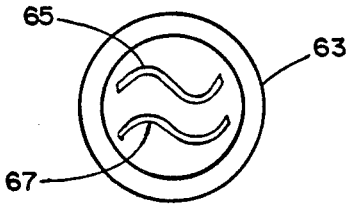

Tobacco material is extruded using materials and conditions generally as described in Example 2, except that the extruder is equipped with the die insert 63 shown in FIG. 5 and a die face rotating cutter unit positioned immediately adjacent to the die face. As shown in FIG. 5, the die 63 has two "S-shaped" openings 65 and 67 extending through the face thereof. Each of openings 65 and 67 have widths of 0.02 inch. The die face cutter unit is operated at 2,000 rpm such that the extrudate is cut at about 1/32 inch intervals yielding generally "S-shaped" strands of about 1/32 inch width and 0.02 inch thickness. The resulting strands are collected. The "S-shaped" strands have absolute lengths of 1 inch, are resilient in character, and exhibit good packing densities. The strands are employed as cigarette cut filler.

EXAMPLE 5

Strand form tobacco extender is provided from tobacco material using the following procedure.

In a plastic bag is mixed 68 g locust bean gum, 68 g xanthan gum, 136 g glycerin, 4534 g tobacco material and 650 g water. The tobacco material is a blend of 40 parts tobacco fines, 30 parts tobacco dust and 30 parts Winnower Throw tobacco stems. The amount of water used is sufficient to provide a resulting mixture having a moisture content of about 25 percent. The bag is hand shaken in order to provide an essentially homogeneous mixture of tobacco material and binding agent. The mixture is removed from the bag and transferred to a vibrating hopper which feeds a twin screw extruder. The twin screw extruder comprises a constant pitch metal screw 16 inches long. The diameter of the screw is 1.5 inch, and the flights are positioned along the length of the screw at a 2 inch pitch. The twin screw extruder feeds into a pressurized roller system. The extruder and roller system is a modified, commercially available TS-10 Roll Press supplied by Material Processing Corporation, Amherst, Illinois, USA. The modifications are performed to the rollers as described hereinafter. The tobacco material/binding agent mixture is passed through the screw extruder which is run at about 30 rpm using a 1.5 HP motor. The temperature within the barrel of the extruder is stabilized at 93° C. The mixture is passed from the extruder through a metal die having a rectangular die opening of 0.25 inch by 4 inches.

Figure 6:
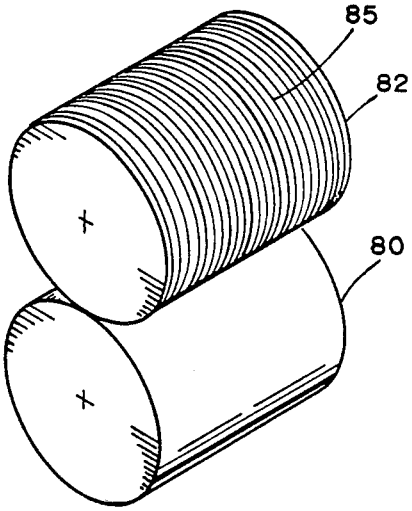
FIG. 6 is a perspective of the roller configuration of the apparatus useful for physically treating extruded material showing a grooved roller and smooth roller in roll contact with one another.
Figure 7:
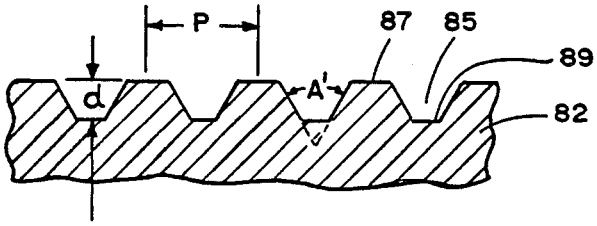
FIG. 7 is an enlarged, partial sectional, longitudinal view of the grooved roller shown in FIG. 6, and showing the series of grooves, each groove extending about the periphery of the roller.

The mixture which has been subjected to high shear exits the die of the twin screw extruder and is fed directly through the nip of two rollers which are in roll contact and form a pressurized roller system (see FIGS. 6 and 7). The rollers 80 and 82 each are generally cylindrical, have a 6 inch diameter, and a longitudinal length of 4 inches. The two rollers 80 and 82 are held in roll contact using jack screws (not shown), and a separating force of 30,000 pounds is generated between the rollers. One of the rollers has a substantially smooth roll face (i.e., roller 80). The other roller 82 is machined in order to have a series of grooves 85 extending along the length of that roller wherein each groove 85 extends about the periphery of the roller essentially transversely to the longitudinal axis of the roller. Each groove 85 has sloping sides and is essentially "V" shaped.

A profile of the roll face of the grooved roller 82 is generally described in FIG. 7. The depth d of the grooves is about 0.0125 inch, the pitch p of each groove is about 0.036 inch, and the angle A' is about 90°. The pitch p is the lateral distance from the center of top portion 87 of the roller face to the center of the nearest adjacent top portion 87. The top portion 87 of each groove is flattened by a distance (extending longitudinally along the roller) of about 0.008 inch, and the bottom portion of 89 each groove is flattened (or slightly rounded) by a distance (extending longitudinally along the roller) of about 0.003 inch. The rollers are operated at a roll speed of from about 10 to about 72 rpm.

Reclaimed tobacco material in strand form is provided from the mixture which passes through the rollers.

EXAMPLE 6

Strand form tobacco material is provided using materials and conditions generally as described in Example 5, except that the die has a shape such that the extrudate exits the die opening directly within the nip of the rollers, and the rollers are heated so as to maintain a temperature of about 82° C. The temperature of the die is about 93° C. The grooved roller is rotated at about 30 rpm and the smooth roller is rotated at about 25 rpm.

The resulting strands of processed tobacco are removed from the face of the smooth roller using a doctor blade, and collected.

What is claimed is:

1. A process for providing smokable material in extruded form, the process comprising:

(a) contacting filler material, at least a portion of which is tobacco material, with a binding agent which includes a galactomannan and xanthan gum; and (b) subjecting the filler material and binding agent to extrusion conditions including temperature and moisture such that the binding agent components can be solubilized and the binding agent is activated.

2. The process of claim 1 whereby the filler material is contacted with a binding agent which includes locust bean gum and xanthan gum.

3. A process for providing smokable material in extruded form, the process comprising:

(a) contacting filler material, at least a portion of which is tobacco material, with a binding agent which includes a galactomannan and kappa-carrageenan; and (b) subjecting the filler material and binding agent to extrusion conditions including temperature and moisture such that the binding agent components can be solubilized and the binding agent is activated.

4. The process of claim 3 whereby the filler material is contacted with binding agent which includes locust bean gum and kappa-carrageenan.

5. The process of claim 1, 2, 3 or 4 whereby the conditions of temperature during extrusion are such that the temperature exceeds 80° C. at some point during extrusion.

6. The process of claim 1, 2, 3 or 4 whereby the filler material and binding agent are contacted with one another while the binding agent is in essentially dry, substantially non-binding form.

7. The process of claim 1, 2, 3 or 4 whereby the moisture content of the filler material and binding agent during extrusion is less than about 40 weight percent, based on the total weight of moisture, filler material and binding agent.

8. The process of claim 1, 2, 3 or 4 whereby the moisture content of the filler material and binding agent during extrusion is less than about 30 weight percent, based on the total weight of moisture, filler material and binding agent.

9. The process of claim 1, 2, 3 or 4 whereby the moisture content of the filler material and binding agent during extrusion is between about 18 weight percent and about 25 weight percent, based on the total weight of moisture, filler material and binding agent.

10. The process of claim 1, 2, 3 or 4 whereby the extrusion conditions are provided using a twin screw extruder.

11. The process of claim 1, 2, 3 or 4 whereby the filler material so contacted with the binding agent is in the form of particulates having a particle size of less than about 40 mesh.

12. The process of claim 1, 2, 3 or 4 whereby the amount of binding agent so provided ranges from 0.2 to 6 percent, based on the weight of the filler material and binding agent.

13. The process of claim 1, 2, 3 or 4 whereby the amount of binding agent so provided is less than 5 percent, based on the weight of the filler material and binding agent.

14. The process of claim 1 or 2 whereby the solubilized binding agent is activated solely as a result of the application of heat thereto.

15. The process of claim 1, 2, 3 or 4 whereby conditions are such that the resulting extruded smokable material is collected, and the extruded smokable material so collected is in strand form.

16. The process of claim 1, 2, 3 or 4 whereby conditions are such that the resulting extruded smokable material is collected, and the extruded smokable material so collected is in sheet-like form.

17. The process of claim 1, 2, 3 or 4 whereby the filler material so provided and so subjected to extrusion conditions is essentially all tobacco material.

18. The process of claim 2 whereby the extrusion conditions are provided using an extruder equipped with a die having at least one orifice, and extrudate exiting the die orifice(s) has a temperature of greater than 55° C. immediately upon exiting the die orifice(s).

19. The process of claim 2 whereby the binding agent includes from about 25 weight percent to about 65 weight percent locust bean gum, and from about 35 weight percent to about 75 weight percent xanthan gum, based on the total weight of the binding agent.

20. The process of claim 1, 2, 3 or 4 whereby the extrusion conditions are provided using an extruder equipped with a die having at least one orifice, and extrudate exiting the die orifice(s) is subjected to physical treatment using a roller system while the temperature of that extrudate is above about 45° C.

21. A process for providing smokable material in extruded form, the process comprising:

(a) providing filler material, at least a portion of which is tobacco material; and
(b) providing xanthan gum; and
(c) providing solubilized galactomannan; and
(d) subjecting the filler material, xanthan gum and solubilized galactomannan to extrusion conditions including temperature and moisture such that the galactomannan and xanthan gum form a binding agent which is activated.

22. A process for providing smokable material in extruded form, the process comprising:

(a) providing filler material, at least a portion of which is tobacco material; and
(b) providing kappa-carrageenan; and
(c) providing solubilized galactomannan; and
(d) subjecting the filler material, kappa-carrageenan and solubilized galactomannan to extrusion conditions including temperature and moisture such that the galactomannan and kappa-carrageenan form a binding agent which is activated.

23. The process of claim 21 whereby the xanthan gum is solubilized prior to being subjected to extrusion conditions with the filler material and solubilized galactomannan.

24. The process of claim 21 whereby filler material, solubilized locust bean gum and xanthan gum are subjected to the extrusion conditions.

25. The process of claim 24 whereby the xanthan gum is solubilized prior to being subjected to extrusion conditions with the filler material and solubilized locust bean gum.

26. The process of claim 21, 22, 23, 24 or 25 whereby the conditions of temperature during extrusion are such that the temperature exceeds 80° C. at some point during extrusion.

27. The process of claim 21, 22, 23, 24 or 25 whereby the moisture content of the filler material and binding agent during extrusion is less than about 40 weight percent, based on the total weight of moisture, filler material and binding agent.

28. The process of claim 21, 22, 23, 24 or 25 whereby the extrusion conditions are provided using a twin screw extruder.

29. The process of claim 21, 22, 23, 24 or 25 whereby the filler material so provided and so subjected to extrusion conditions is essentially all tobacco material.

30. The process of claim 21, 22, 23, 24 or 25 whereby the extrusion conditions are provided using an extruder equipped with a die having at least one orifice, and extrudate exiting the die orifice(s) is subjected to physical treatment using a roller system while the temperature of that extrudate is above about 45° C.

31. The process of claim 24 or 25 whereby the extrusion conditions are provided using an extruder equipped with a die having at least one orifice, and extrudate exiting the die orifice(s) has a temperature of greater than 55° C. immediately upon exiting the die orifice(s).

32. A process for providing smokable material in extruded form, the process comprising:

(a) contacting filler material, at least a portion of which is tobacco material, with a binding agent which includes a galactomannan and xanthan gum; and
(b) subjecting the filler material and binding agent to extrusion conditions at a moisture level between about 15 weight percent and about 45 weight percent, and a temperature of at least about 80° C.

33. The process of claim 32 whereby the filler material is contacted with a binding agent which includes locust bean gum and xanthan gum.

34. The process of claim 32 or 33 whereby the filler material and binding agent are contacted with one another while the binding agent is in essentially dry, substantially non-binding form.

35. The process of claim 32 or 33 whereby the moisture content of the filler material and binding agent mixture during extrusion is between about 17 weight percent and about 30 weight percent, based on the total weight of moisture, filler material and binding agent.

36. The process of claim 32 or 33 whereby the moisture content of the filler material and binding agent mixture during extrusion is between about 18 weight percent and about 25 weight percent, based on the total weight of moisture, filler material and binding agent.

37. The process of claim 32 or 33 whereby the filler material so contacted with the binding agent is in the form of particulates having a particle size of less than about 40 mesh.

38. The process of claim 32 or 33 whereby the amount of binding agent so provided is less than 5 percent, based on the dry weight of the filler material and binding agent.

39. The process of claim 32 or 33 whereby the filler material so provided and so subjected to extrusion conditions is essentially all tobacco material.

40. The process of claim 32 or 33 whereby the extrusion conditions are provided using an extruder equipped with a die having at least one orifice, and extrudate exiting the die orifice(s) has a temperature of greater than 55° C. immediately upon exiting the die orifice(s).

41. The process of claim 32 or 33 whereby the extrusion conditions are provided using an extruder equipped with a die having at least one orifice, and extrudate exiting the die orifice(s) is subjected to physical treatment using a roller system while the temperature of that material is above about 45° C.

42. A process for providing smokable material in extruded form, the process comprising:

(a) contacting filler material, at least a portion of which is tobacco material, with a binding agent which includes as components at least two binders, which binding agent can be activated as a result of thermally initiated inter polymer chain associations between the component binders; and (b) subjecting the filler material and binding agent to extrusion conditions including temperature and moisture such that the binders are solubilized and the binding agent is activated.

43. The process of claim 42 whereby the extrusion conditions are provided using an extruder equipped with a die having at least one orifice, and extrudate exiting the die orifice is subjected to conditions suitable to cause gelation of the binding agent thereof.

44. The process of claim 42 or 43 whereby the moisture content of the filler material and binding agent mixture during extrusion is between about 18 weight percent and about 25 weight percent, based on the total weight of moisture, filler material and binding agent.

45. The process of claim 42 or 43 whereby the filler material so provided and so subjected to extrusion conditions is essentially all tobacco material.

46. The process of claim 42 or 43 whereby the amount of binding agent so provided is less than 5 percent, based on the dry weight of the filler material and binding agent.

47. The process of claim 42 or 43 whereby the extrusion conditions are provided using a twin screw extruder.

48. The process of claim 42 or 43 whereby the extrusion conditions are provided using an extruder equipped with a die having at least one orifice, and extrudate exiting the die orifice(s) is subjected to physical treatment using a roller system while the temperature of that material is above about 45° C.

49. A process for providing smokable material in extruded form, the process comprising:

(a) providing filler material, at least a portion of which is tobacco material; and (b) providing binder components of a binding agent, which binding agent can be activated as a result of thermally initiated inter polymer chain associations between the component binders; and (c) solubilizing the binder components; and (d) contacting the filler material with the solubilized binder components; and (e) subjecting the filler material and solubilized binder components to extrusion conditions including temperature and moisture such that the binder components form a binding agent which is activated.

50. The process of claim 49 whereby the extrusion conditions are provided using an extruder equipped with a die having at least one orifice, and extrudate exiting the die orifice is subjected to conditions suitable to cause gelation of the binding agent thereof.

51. The process of claim 49 or 50 whereby the moisture content of the filler material and binding agent mixture during extrusion is between about 18 weight percent and about 25 weight percent, based on the total weight of moisture, filler material and binding agent.

52. The process of claim 49 or 50 whereby the filler material so provided and so subjected to extrusion conditions is essentially all tobacco material.

53. The process of claim 49 or 50 whereby the amount of binding agent so provided is less than 5 percent, based on the dry weight of the filler material and binding agent.

54. The process of claim 49 or 50 whereby the extrusion conditions are provided using a twin screw extruder.

55. The process of claim 49 or 50 whereby the extrusion conditions are provided using an extruder equipped with a die having at least one orifice, and extrudate exiting the die orifice(s) is subjected to physical treatment using a roller system while the temperature of that material is above about 45° C.

* * * * *